US006118853A

United States Patent [19]

Hansen et al.

[11] Patent Number: 6,118,853

[45] Date of Patent: Sep. 12, 2000

[54] X-RAY TARGET ASSEMBLY

[75] Inventors: William H. Hansen; Peter E. Loeffler, both of Los Gatos, Calif.

[73] Assignee: Cardiac Mariners, Inc., Los Gatos, Calif.

[21] Appl. No.: 09/167,523

[22] Filed: Oct. 6, 1998

[51] Int. Cl.[7] ..... H01J 35/08

[52] U.S. Cl. ..... 378/143; 378/144

[58] Field of Search ..... 378/143, 144

[56] References Cited

U.S. PATENT DOCUMENTS

| | | | |
|---|---|---|---|
| 2,638,554 | 5/1953 | Bartow et al. | 250/99 |
| 2,837,657 | 6/1958 | Craig et al. | 250/65 |
| 3,925,660 | 12/1975 | Albert | 250/272 |
| 3,949,229 | 4/1976 | Albert | 250/401 |
| 3,983,397 | 9/1976 | Albert | 250/406 |
| 4,002,917 | 1/1977 | Mayo | 250/445 |
| 4,007,375 | 2/1977 | Albert | 250/404 |
| 4,048,496 | 9/1977 | Albert | 250/272 |
| 4,144,457 | 3/1979 | Albert | 250/445 |
| 4,259,582 | 3/1981 | Albert | 250/402 |
| 4,259,583 | 3/1981 | Albert | 250/416 |
| 4,260,885 | 4/1981 | Albert | 250/277 |
| 4,323,779 | 4/1982 | Albert | 250/401 |
| 4,519,092 | 5/1985 | Albert | 378/45 |
| 4,730,350 | 3/1988 | Albert | 378/10 |
| 5,122,422 | 6/1992 | Rodhammer et al. | 428/634 |
| 5,267,296 | 11/1993 | Albert | 378/113 |
| 5,420,906 | 5/1995 | Smit et al. | 378/143 |
| 5,550,378 | 8/1996 | Skillicorn et al. | 250/367 |
| 5,610,967 | 3/1997 | Moorman et al. | 378/154 |

FOREIGN PATENT DOCUMENTS

| | | | |
|---|---|---|---|
| WO 94/23458 | 10/1994 | WIPO | H01L 31/115 |
| WO 96/25024 | 8/1996 | WIPO | H05J 35/00 |

OTHER PUBLICATIONS

Nixon, "High–Resolution X–ray Projection Microscopy", Nov. 1955, *Proceedings of the Royal Society of London*, vol. 232, pp. 475–484.

Skillicorn, "Insulators and X–ray Tube Longevity: Some Theory and a Few Practical Hints", *Kevex*, Jun., 1983, pp. 2–6.

Curry et al., *Christensen's Physics of Diagnostic Radiology*, Fourth Edition, Lea & Febiger, 1990, pp. 1–522.

*Primary Examiner*—Craig E. Church
*Attorney, Agent, or Firm*—Lyon & Lyon LLP

[57] ABSTRACT

An x-ray transmission target assembly is disclosed. According to an aspect of the invention, an x-ray target assembly comprises an x-ray generating layer, a thermal buffer, and a support, wherein the thermal buffer is disposed between the x-ray generating layer and support. Another aspect of the invention is directed to a novel material for use as an x-ray generating layer in an x-ray target assembly.

31 Claims, 1 Drawing Sheet

X-RAY TARGET ASSEMBLY

BACKGROUND

1. Field of the Invention

The present invention pertains to the field of x-ray sources and amongst other things to targets for x-ray sources.

2. Background of the Invention

In conventional x-ray sources, x-ray radiation is produced by colliding an accelerated stream of charged particles (e.g., electrons) into a solid body. This solid body is often referred to as a "target" or "target assembly." In general, x-rays are produced from the interaction between the energy of the fast moving electrons and the structure of the atoms of the target assembly material. X-rays radiate in all directions from the area on the target assembly where the collisions take place.

"Transmission" targets are employed in x-ray sources in which the useful x-rays are taken from the opposite side of the target from the incident electron stream. This is in contrast to "reflective" targets, in which the useful x-rays are taken from the same side of the target as the incident electron stream.

A significant effect of the x-ray generation process is the production of heat at the target assembly when electrons decelerate within the target assembly material. In conventional x-ray sources, the majority of the incident energy of the electrons is dissipated as heat within the target assembly, while only a relatively small percentage of the incident energy results in the emission of x-rays. If the electron stream is directed at the target assembly as a tightly focussed beam of electrons, high temperatures are generated at a relatively small spot size on the target assembly.

The power handling characteristics of x-ray sources are often limited by the ability of the target assembly to dissipate heat generated at the area of impact of an electron beam. The load that can be safely handled by a particular x-ray source is typically limited by the specific materials forming the x-ray source target assembly and is a function of the heat energy produced during the exposure of the target assembly to the electron beam. The target assembly materials may suffer significant damage (e.g., the target assembly materials may melt or vaporize) if the heat limit of the target assembly materials is exceeded. Factors that affect the amount of heat that can be absorbed without damage include the total area of the target assembly material bombarded by the electron beam, the energy and power of the electron beam employed, the duration of exposure, as well as the melting point of particular target assembly materials.

The particular materials employed in a target assembly play an important factor in determining how much x-ray radiation will be produced by a given stream of electrons. The amount of x-rays produced by the x-ray generating material of a target assembly is a function of the atomic number of the x-ray generating material. In general, materials having a high atomic number are more efficient at x-ray production than materials having lower atomic numbers. However, many high atomic number materials have low melting points, making them generally unsuitable in an x-ray target assembly. Many low atomic materials have good heat-handling characteristics, but are less efficient for the production of x-rays. Tungsten has been commonly employed as a x-ray generating material because of its combination of a high atomic number (Z=74 ), as well as its relatively high melting point (3370° C.).

A transmission target assembly is typically formed with a thin layer of x-ray generating material supported by a substrate made from a material that is relatively transmissive to x-rays. The x-ray generating material is typically a relatively thin layer to minimize self-absorption of the generated x-rays. The substrate material used to support the target material is normally formed from a relatively x-ray transmissive material to avoid attenuating the generated x-rays. In general, a low atomic number material is desirable for use as the substrate material because of its x-ray transmissiveness characteristics. However, such materials typically have a lower melting point than the higher-atomic number materials used for the x-ray producing layer. Because of the transfer of heat from the x-ray generating material to the supporting substrate, the maximum allowable temperature of the transmission target assembly is often limited by the choice of the substrate material rather than the x-ray generating material.

Accordingly there is a need for an x-ray target assembly that is efficient for the production of x-rays, but is capable of withstanding the heat generated from being bombarded with a high power electron beam.

SUMMARY OF THE INVENTION

The present invention comprises an x-ray target assembly having efficient thermal handling properties when bombarded with a stream of charged particles to produce x-rays. According to an aspect of the invention, an x-ray target assembly comprises an x-ray generating layer, a support, and a thermal buffer disposed between the x-ray generating layer and support. Another aspect of the invention is directed to a novel x-ray generating material for use in an x-ray target assembly.

These and other objects, aspects, and advantages of the present inventions are taught, depicted and described in the drawings, detailed description, and claims of the invention contained herein.

DETAILED DESCRIPTION OF EMBODIMENT(S)

Figure 3:
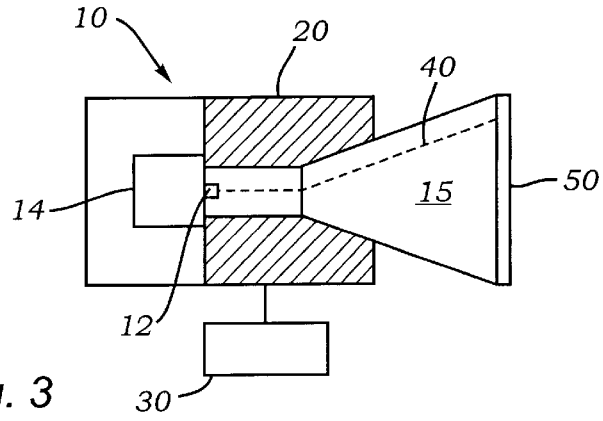
FIG. 3 is a diagram showing the high level components of an x-ray source.

FIG. 3 is a diagram showing the high level components of an x-ray source 10. X-ray source 10 includes a charged particle gun 12 that is controlled by charged particle gun electronics 14. A target assembly 50 is located opposite the charged particle gun 12. According to an embodiment, the area 15 between the target assembly 50 and charged particle gun 12 is maintained as a vacuum, with target assembly 50 forming one end of a vacuum chamber. The x-ray source 10 is operated such that a voltage potential exists between the charged particle gun 12 and the target assembly 50. This voltage potential causes charged particles generated at charged particle gun 12 to be emitted as a charged particle beam 40 at the target assembly 50. Charged particle beam 40 is deflected over the surface of a target assembly 50 (which is a grounded anode in an embodiment of the invention) in a predetermined pattern, e.g., a scanning or stepping pattern. X-ray source 10 includes a mechanism to control the movement of charged particle beam 40 across the surface of target assembly 50, such as a deflection yoke 20 under the control of a beam pattern generator 30. An exemplary x-ray source is disclosed in more detail in copending U.S. patent application Ser. No. [Not Yet Assigned] (Attorney Dkt. No. 232/011), filed on even day herewith, which is incorporated herein by reference in its entirety. A method and apparatus for generating and moving electron beam 40 across target assembly 50 is disclosed in commonly owned U.S. Pat. No. 5,644,612 which is incorporated herein by reference in its entirety.

Figure 1:
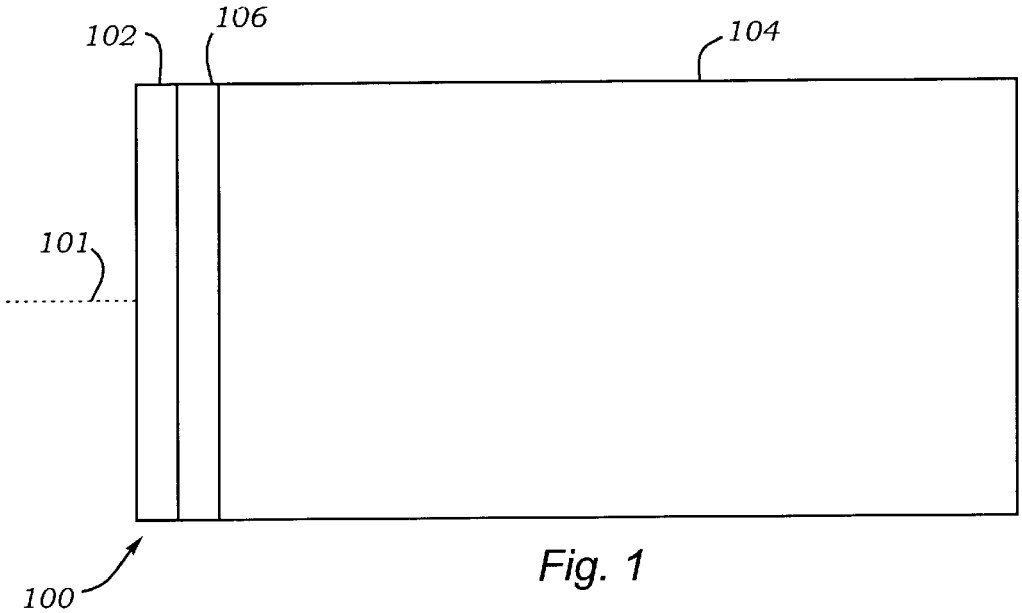
FIG. 1 is a diagram of an x-ray target assembly according to an embodiment of the present inventions.

Referring to FIG. 1, shown is an x-ray target assembly 100 according to an embodiment of the invention. In operation, a charged particle source projects a high speed beam 101 of charged particles (e.g., electrons) at x-ray target assembly 100. X-ray target assembly 100 comprises a x-ray generating layer 102 that is formed from a material that can efficiently produce x-rays when bombarded with charged particle beam 101. The x-ray generating layer 102 preferably comprises a material having a high atomic number. Examples of materials that can be employed as x-ray generating layer 102 include tantalum-carbide, tungsten, and gold. An important factor in choosing the material for x-ray generating layer 102 is that the chosen material have a melting point that can withstand the temperature range that results when a beam 101 of charged particles is bombarded against x-ray target assembly 100.

X-ray target assembly 100 includes a support 104 to support the x-ray generating layer 102. Support 104 provides a supporting structure to prevent mechanical deformation of the x-ray generating layer 102. The material used for support 104 is preferably relatively x-ray transmissive to reduce attentuation of x-rays generated at x-ray generating layer 102. In an embodiment, support 104 should not only have a high mechanical tensile strength but should also provide some heat conducting capabilities, due to its proximity to x-ray generating layer 102. An additional function which can be performed by the support 104 includes bulk thermal conduction. Further, when used in a x-ray source (such as x-ray source 10), support 104 can also function as a vacuum seal for a vacuum chamber. An example of a material that can be employed in support 104 is beryllium.

Disposed between the x-ray generating layer 102 and the support 104 is a thermal buffer 106. Thermal buffer 106 comprises a material that decreases the rate of heat transfer from the x-ray generating layer 102 to the support 104. Essentially, thermal buffer 106 acts as a heat resistor that regulates the transfer of heat between x-ray generating layer 102 and support 104. Desirable properties of the material chosen for thermal buffer 106 include high x-ray transmissiveness properties, high melting point (to withstand the high temperatures generated at the x-ray generating layer 102), and a coefficient of thermal expansion between that of the x-ray generating layer 102 and support 104. The material of the thermal buffer 106 can be chosen for the property that it does not undergo any phase transitions in the operating temperature range of the x-ray target assembly 100, nor form an eutectic with any adjacent material(s). In the preferred embodiment, the thermal buffer material should be chosen to withstand heat in excess of 2000° C. Examples of materials that can be used within thermal buffer 106 include niobium, titanium carbide, molybdenum-rhenium, hafnium, zirconium, and other low atomic number-high temperature resistant non-allotropic materials.

The use of the thermal buffer 106 allows an increase in the maximum temperature that can be generated at the x-ray generating layer 102. The material of the x-ray generating layer 102 generally has a higher melting point than the material of the support 104. Thus, the heat-handling capabilities (which corresponds to the x-ray generating capacity) of an x-ray target assembly 100 may be limited by the lower melting point of the support 104. Because thermal buffer 106 regulates the rate at which heat is transferred to support 104, greater amount/rate of heat can be generated at the x-ray generating layer 102.

The present invention is particularly useful in "pulsed" x-ray source applications, where the charged particle beam 101 is moved across a target assembly in a particular pattern that produces pulses of x-rays. When utilizing a pulsed x-ray source having a relatively low duty cycle, it can be advantageous to limit the rate of heat flow from the x-ray generating layer to the support. This allows the temperature of the x-ray producing material to rise to a temperature higher than the maximum allowed temperature of the support. The low duty cycle permits the materials of the target assembly to cool down prior to the next projection of charged particles at a particular location on the target.

In an alternate embodiment, the same material used as the x-ray generating layer 102 is also used as the thermal buffer 106. In this embodiment, the material of the x-ray generating layer 102 is formed thicker than is necessary to generate x-rays. A first portion of the material comprises the x-ray generating layer 102, wherein this first portion corresponds to the penetration depth of the charged particle beam 101 that is bombarding the target assembly 100. Most of the generated x-rays are produced by this first portion of the material. A second portion of the material comprises the additional depth of material beyond the first portion. This second portion comprises the thermal buffer 106, which regulates the transfer of heat from the first portion of the material to support 106.

Note that conventional target assembly materials are generally not suitable to be used as both the x-ray generating layer 102 and thermal buffer 106. Conventional materials used to efficiently generate x-rays will also efficiently attenuate x-rays, and thus, a significant portion of the generated x-rays may be lost in the thicker layers of the x-ray producing material. Moreover, conventional material used to generate x-rays also tend not to possess low thermal conductivity, making such materials less efficient as a thermal buffer.

An embodiment of the present invention utilizes a novel material, tantalum carbide, as the x-ray generating layer 102. Tantalum carbide is an effective x-ray producing material, as well as a material that has a relatively low coefficient of thermal conductivity. Thus, tantalum carbide can be efficiently used as both the x-ray generating layer 102 and the thermal buffer 106. Moreover, the composition of tantalum carbide allows a thicker layer of the material be used in x-ray target assembly 100 without the portion of the material functioning as the thermal buffer 106 excessively attenuating the x-rays produced by the portion of the material functioning as the x-ray generating layer 102. Thus, tantalum carbide is an example of a material that can be employed as both the x-ray generating layer 102 and thermal buffer 106.

Figure 2:
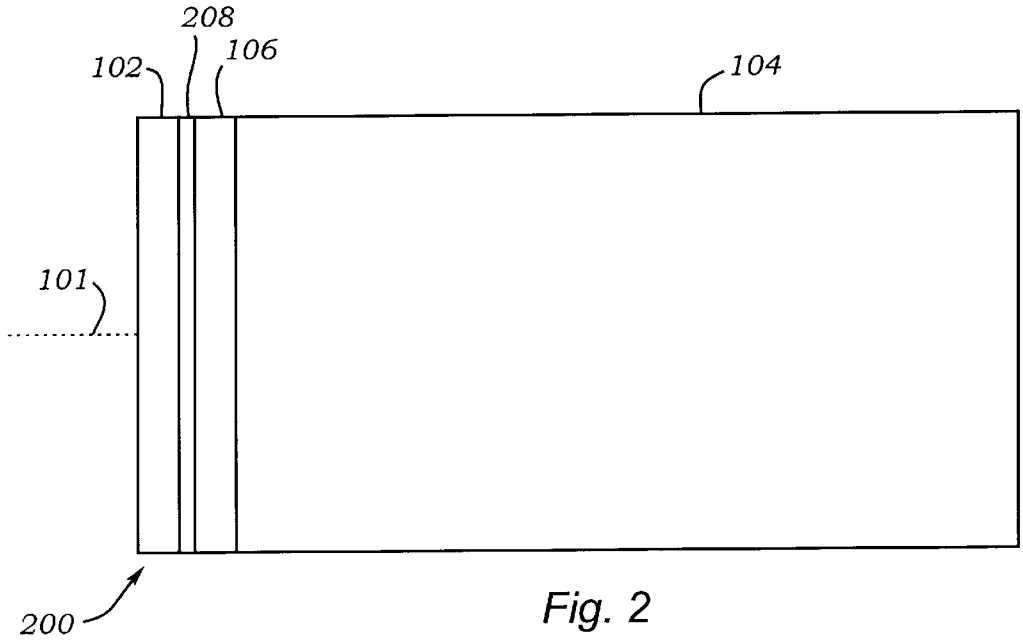
FIG. 2 is a diagram of an alternate x-ray target assembly according to the present inventions.

FIG. 2 depicts an alternate x-ray target assembly 200. Referring to FIG. 2, an additional layer of material 208 can be disposed between the thermal buffer 106 and the x-ray generating layer 102. In an embodiment, layer 208 comprises a diffusion barrier material that prevents or reduces the movement of atoms from the x-ray generating layer 102 into the thermal buffer 106. This type of movement may occur because of the high temperatures generated in the x-ray generating layer 102. Factors that can be used to select the diffusion barrier material includes the strength of the internal bonds for the material and the material's ability to withstand the high temperatures generated at the x-ray generating layer 102. An example of a material that can be used for diffusion barrier 208 is titanium nitride.

Table 1 provides a possible configuration of materials that can be employed in an embodiment of the target assembly shown in FIG. 2:

TABLE 1

| Layer | Thickness | Material |
|---|---|---|
| x-ray generating layer | 12 μm | 95% tungsten/5% rhenium |
| Diffusion layer | 0.2 μm | Titanium nitride |
| Thermal buffer | 10 μm | Niobium |
| Support | 5 mm | Beryllium |

Layer 208 can comprise a material that functions as a bonding or adhesive material. A bonding material is utilized if the materials chosen for two adjacent layers have difficulty adhering to each other. For example, under certain circumstances, difficulties may occur when attempting to adhere a titanium carbide material directly to a tantalum carbide material. If the chosen material for x-ray generating layer 102 is tantalum carbide and the chosen material for thermal buffer 106 is titanium carbide, then a bonding material can be disposed between these two layers of materials. A desirable property of the bonding material is the ability to withstand the high temperatures generated at the x-ray generating layer 102.

Table 2 provides a possible configuration of materials that can be employed in an alternate embodiment of the target assembly shown in FIG. 2:

TABLE 2

| Layer | Thickness | Material |
|---|---|---|
| X-ray generating layer | 12 μm | Tantalum carbide |
| Bonding layer | 2 μm | Blend varying from 100% Tantalum carbide/0% Titanium carbide to 0% Tantalum carbide/1000% Titanium carbide |
| Thermal buffer | 10 μm | Titanium carbide |
| Support | 5 mm | Beryllium |

In an embodiment, a single material used in layer 208 can function as both a diffusion barrier material and a bonding material. Alternatively, layer 208 can comprise a plurality of different materials that separately perform the functions of the diffusion barrier and bonding materials. Yet another alternative is the use of a single material in layer 208 that only performs as a diffusion barrier or the use of a single material that only performs as a bonding material.

A presently preferred method of manufacturing the x-ray target assembly comprises sputter depositing the x-ray generating layer 102, thermal buffer 106, diffusion and/or adhesion layers 208 in the proper order onto the support 104.

For example, for embodiments illustrated by the description in Table 2, the material of the thermal buffer 106 is first deposited to the desired depth onto the support 104. When the material of the thermal buffer 106 has reached the desired depth, the sputtering mechanism adjusts its material flow such that a blend of materials is deposited. The blend of materials comprises layer 208, and is a mixture of the material of the thermal buffer 106 (e.g. titanium carbide) and the material of the x-ray generating layer 102 (e.g., tantalum carbide). When the blended materials of layer 208 has reached the desired depth, the sputtering mechanism adjusts its material flow such that only the material of the x-ray generating layer 102 is deposited. The material of the x-ray generating layer 102 is thereafter deposited to the desired depth. In an embodiment, the blended materials of layer 208 is not a uniform mixture of material throughout the depth of the entire layer 208. Instead, the proportional amount of the various materials are gradually adjusted through the depth of layer 208, such that layer 208 ranges from a blend of 100% thermal buffer material/0% x-ray generating material at thermal buffer 106 to a blend of 0% thermal buffer material/100% x-ray generating material at the x-ray generating layer 102. Between the x-ray generating layer 102 and support 106, the mixture varies in composition based upon the rate of mixing imposed at the sputtering mechanism.

While the embodiments, applications and advantages of the present inventions have been depicted and described, there are many more embodiments, applications and advantages possible without deviating from the spirit of the inventive concepts described herein. Thus, the inventions are not to be restricted to the preferred embodiments, specification or drawings. The protection to be afforded this patent should therefore only be restricted in accordance with the spirit and intended scope of the following claims.

What is claimed is:

1. An x-ray target assembly comprising:

an x-ray generating material having a first melting point;

a support having a second melting point;

a thermal buffer disposed between said x-ray generating material and said support; and said first melting point being greater than said second melting point.

2. The x-ray target assembly of claim 1 further comprising a layer of material disposed between said x-ray generating material and said thermal buffer.

3. The x-ray target assembly of claim 2 in which said layer of material comprises a bonding material.

4. The x-ray target assembly of claim 3 in which said layer of material comprises a titamum carbide-tantalum carbide compound.

5. The x-ray target assembly of claim 2 in which said layer of material comprises a diffusion barrier material.

6. The x-ray target assembly of claim 5 in which said layer of material comprises titanium nitride.

7. The x-ray target assembly of claim 1 wherein said thermal buffer comprises a material having a low coefficient of thermal conduction.

8. The x-ray target assembly of claim 1 wherein said thermal buffer comprises a material having a first coefficient of thermal expansion, said x-ray generating material comprises a second coefficient of thermal expansion, and said thermal buffer comprises a third coefficient of thermal expansion, and wherein said the value of said first coefficient of thermal expansion is between the values of said second and third coefficients of thermal expansion.

9. The x-ray target assembly of claim 1 wherein said x-ray generating material comprises a material selected from the group consisting of tungsten, gold, tungsten rhenium and tantalum carbide.

10. The x-ray target assembly of claim 1 wherein said thermal buffer is a material selected from the group consisting of niobium, titanium carbide, hainium, and zirconium.

11. The x-ray target assembly of claim 1 wherein said x-ray generating material comprises a x-ray generating layer depth and said support comprises a support depth, and wherein said x-ray generating layer depth is less than said support depth.

12. The x-ray target assembly of claim 1 wherein said thermal buffer comprises a third melting point, and said third melting point being greater than said second melting point.

13. The x-ray target assembly of claim 1 wherein said x-ray generating material and said thermal buffer comprise the same material.

14. The x-ray target assembly of claim 13 wherein said x-ray generating material and said thermal buffer comprise a tantalum carbide material.

15. An x-ray source comprising:

a charged particle gun;

a charged particle gun electronics that transmit and receive signals to control said charged particle gun; and a target assembly comprising an x-ray generating material, a support material, and a thermal buffer, said x-ray generating material having a first melting point; said support material having a second melting point; said thermal buffer disposed between said x-ray generating material and said support material, and said first melting point being greater than said second melting point.

16. The x-ray source of claim 15 in which a surface of said target assembly comprises one end of a vacuum chamber.

17. The x-ray source of claim 15 further comprising a layer of material disposed between said x-ray generating material and said thermal buffer.

18. The x-ray source of claim 17 in which said layer of material comprises a bonding material.

19. The x-ray source of claim 18 in which said layer of material comprises a titanium carbide-tantalum carbide compound.

20. The x-ray source of claim 17 in which said layer of material comprises a diffusion barrier material.

21. The x-ray source of claim 20 in which said layer of material comprises titanium nitride.

22. The x-ray source of claim 21 wherein said support material comprises a material having a low atomic number.

23. The x-ray source of claim 15 wherein said thermal buffer comprises a material having a low coefficient of thermal conduction.

24. The x-ray source of claim 15 wherein said thermal buffer comprises a material having a first coefficient of thermal expansion, said x-ray generating material comprising a second coefficient of thermal expansion, and said thermal buffer having a third coefficient of thermal expansion, and wherein the value of said first coefficient of thermal expansion is between the values of said second and third coefficients of thermal expansion.

25. The x-ray source of claim 15 wherein said x-ray generating material comprises a material selected from the group consisting of tungsten, gold tungsten rhenium and tantalum carbide.

26. The x-ray source of claim 15 wherein said thermal buffer is a material selected from the group consisting of niobium, titanium carbide, hafnium, and zirconium.

27. The x-ray target assembly of claim 15 wherein said x-ray generating material and said thermal buffer comprise the same material.

28. The x-ray target assembly of claim 27 wherein said x-ray generating material and said thermal buffer comprise a tantalum carbide material.

29. An x-ray target assembly comprising an x-ray generating layer of material, said x-ray generating layer of materials producing x-rays when bombarded with a stream of charged particles, said x-ray generating layer of material comprising tantalum carbide.

30. The x-ray target assembly of claim 29 further comprising a thermal buffer.

31. The x-ray target assembly of claim 30 wherein said thermal buffer comprises tantalum carbide.

* * * * *